US008128386B2

(12) United States Patent
Veilleux, Jr.

(10) Patent No.: US 8,128,386 B2
(45) Date of Patent: Mar. 6, 2012

(54) VARIABLE FLOW PUMPING SYSTEM

(75) Inventor: Leo J. Veilleux, Jr., Wethersfield, CT (US)

(73) Assignee: Hamilton Sundstrand Corporation, Rockford, IL (US)

( * ) Notice: Subject to any disclaimer, the term of this patent is extended or adjusted under 35 U.S.C. 154(b) by 507 days.

(21) Appl. No.: 12/215,248

(22) Filed: Jun. 26, 2008

(65) Prior Publication Data

US 2009/0324438 A1 Dec. 31, 2009

(51) Int. Cl.
*F03C 4/00* (2006.01)
*F04C 14/18* (2006.01)
*F04C 2/00* (2006.01)

(52) U.S. Cl. ..... 418/30; 418/27; 418/31; 417/220

(58) Field of Classification Search ..... 418/26–30, 418/31; 417/220
See application file for complete search history.

(56) References Cited

U.S. PATENT DOCUMENTS 4,259,039 A * 3/1981 Arnold ..... 417/220
4,325,215 A * 4/1982 Yamamoto ..... 417/220
4,715,180 A * 12/1987 Rosman ..... 60/372
4,770,401 A * 9/1988 Donaldson ..... 269/249
5,110,100 A * 5/1992 Cotton ..... 269/244
5,538,400 A 7/1996 Konishi et al.
5,715,674 A 2/1998 Reuter et al.
5,806,300 A 9/1998 Veilleux, Jr. et al.
6,102,001 A 8/2000 McLevige
6,398,528 B1 6/2002 Hansen et al.
6,402,487 B1 6/2002 Clements et al.
6,526,743 B2 * 3/2003 Maker et al. ..... 60/39.281
6,821,093 B2 11/2004 Zagranski et al.
7,083,394 B2 * 8/2006 Dalton ..... 417/220
7,293,765 B2 * 11/2007 Hooper ..... 269/246
2002/0109427 A1 * 8/2002 Hochhalter et al. ..... 310/89

* cited by examiner

*Primary Examiner* — Theresa Trieu
(74) *Attorney, Agent, or Firm* — Kinney & Lange, P.A.

(57) ABSTRACT

A variable displacement pump and pump control system therefor to pump a fluid at selected pump output flow rates having a variable displacement pump and a fluid volume displacement selection controller to select a volume of fluid to be forced from the pump inlet to the pump outlet by the rotating member during a rotation thereof. A movable lead screw is coupled to the displacement selection controller so as to be capable of altering the position thereof, and a lead screw positioner is provided for selectively moving, or preventing the moving of, the movable lead screw by extending and retracting the lead screw through a threaded opening.

20 Claims, 6 Drawing Sheets

VARIABLE FLOW PUMPING SYSTEM

BACKGROUND

The present invention relates to control of the operation of rotary positive displacement fluid pumps and, more particularly, to control of the operation of variable flow rate rotary positive displacement fluid pumps.

Rotary positive displacement fluid pumps are operated relatively simply by connecting the pump rotor to a source of mechanical torque, typically an electric motor or an engine, either directly or through some kind of a mechanical interconnection arrangement such as gears. The resulting rotation rate of the pump rotor determines the volume of the pump output fluid flow, and so a substantially constant engine rotation rate leads to a substantially constant pump output fluid flow rate. Such a pumping arrangement for providing fuel to gas turbine engines has been common in the past with the mechanical torque source having been a shaft extending to the pump rotor from the accessory gearbox of the gas turbine engine receiving the flow of fuel from the pump.

However, gas turbine engines used in aircraft operate over a rather large range of engine rotation rates in rotating the gears in its accessory gearbox, and so often, at greater engine rotation rates, such engines cause the fuel supplied thereto by the corresponding fuel pump formed by a rotary positive displacement fluid pump to be in quantities that are substantially in excess of that needed to fuel operation of the engine. As a result, the excess fuel is typically recirculated back to a location in the fuel delivery system ahead of the fuel pump inlet. Such pressurizing of the fuel by the pump, and then the subsequent depressurizing thereof in returning that excess fuel to ahead of the pump inlet, more or less continually over a span of time causes the fuel to become significantly heated. The ensuing large fuel temperature increases have various detrimental effects with respect to operation of the turbine engine.

Avoiding much of such heating has been accomplished by substituting variable flow rate control of rotary positive displacement fluid pumps in such a manner as make the pump output flow rate much less dependent on the rotation rate of the pump rotor, and so much less dependent on the rotation rates in the accessory gearbox of the gas turbine engines to which they are correspondingly supplying fuel. Typically, a vane pump is used as a rotary positive. displacement fluid pump serving as the fuel pump in which the pump displacement can be varied, as well as the rotation rate of the pump rotor, to together determine the pump output flow rate. The variation of pump displacement can be achieved, for example, by changing the relative position of typically, a cam and the pump rotor within which that pump rotor is mounted off center to move cycloidally with respect thereto. Alternatively, a reciprocating piston pump with a variable position swash plate can be used to provide a variable rotation rate, variable displacement pump for a fuel pump. Relatively elaborate hydraulic pump control systems use the fuel as the "working fluid" in the control system, i.e. a "fueldraulics" control system, as well as that fluid being supplied by the pump and its control system to the corresponding gas turbine engine to be the engine fuel therefor.

Such a pump displacement (and so pump output flow rate) control system and vane pump arrangement, 10, is shown in a schematic representation block diagram in FIG. 1. A vane pump, 11, is shown with an inlet, 12, to which fuel is supplied through an inlet pressure source, 12', and the pump is also is connected to a shaft, 13, to which torque for rotating the pump rotor is supplied as a result of this shaft extending to the accessory gearbox of a gas turbine engine (not shown). Vane pump 11 has an outlet, 14, from which fuel pressurized by this pump is provided both to a pressured fluid conduit, 15, to a metering valve, 16, and an excess flow. bypass conduit, 17. Valve 16, in cooperation with a regulator, 18, operates to provide the desired rate of fuel flow at its outlet, 19, to the gas turbine engine combustor (not shown) in compensating for the loss of fuel from the output of vane pump 11 through pressured fluid conduit 15. The overflow fuel is sent to regulator 18, through excess flow bypass conduit 17, and recirculated to vane pump 11 through a recirculation conduit, 20, carrying the fuel to inlet 12. The overflow amount is determined by regulator 18 determining the differential pressure across metering valve 16 through a pair of differential pressure sensing conduits, 21.

The main control for the displacement of pump 11 is provided typically as part of the engine electronic controller, 22, which receives both commands to change thrust and various sensor inputs at its input, 23. Controller 22 through an electrical interconnection, 24, operates an electrohydraulic servovalve, 25, with excess fluid therein returned to vane pump 11 through an excess fluid return conduit, 25', carrying the fuel to recirculation conduit 20. Electrohydraulic servovalve 25 in turn operates a hydraulic actuator, 26, through adding fluid thereto and removing fluid therefrom in control conduits, 27, to thereby force its output ram shaft, 28, to the left or right in FIG. 1. Such motion of output ram shaft 28 thereby alters the position of the typical cycloidal motion cam in vane pump 11 so as to either increase or decrease the fluid displacement of that pump. An output ram shaft position sensor, 29, provides a signal representing the linear position of that shaft as a feedback signal to controller 22. Thereby, controller 22 controls the fuel output flow rate of that pump through outlet 14 thereof. In addition, pressured fluid conduit 15 allows the pressurized fuel output of pump 11 to be supplied to electrohydraulic servovalve 22 to provide steady quiescent flow as well as provide transient flow to actuate pump transients.

Such an elaborate electrohydraulic control system for vane pumps requires quite a number of component parts some of which are relatively expensive, plus requires quiescent flow and transient flows, affecting dynamic fuel response to the gas turbine engine, as well as pump sizing, and has limitations in failure modes such as in its ability to provide fixed fuel flow following a failure. In addition, various failure modes are introduced in such a complex system with so many system components, and the working fluid used therein is subject to contamination leading to further possible failure modes. Thus, there is a desire for a less complex control for controlling the displacement of vane pumps especially those used as fuel pumps for gas turbine engines.

SUMMARY

The present invention provides a variable displacement pump and pump control system therefor to pump a fluid at selected pump output flow rates in a range of pump output flow rates. The variable displacement pump has a rotor shaft with which to rotate a pump rotating member about an axis of rotation to force fluid that has entered a pump inlet to a pump outlet, and a fluid volume displacement selection controller to select a volume of fluid to be forced from the pump inlet to the pump outlet by the rotating member during a rotation thereof. A movable lead screw is coupled to the displacement selection controller so as to be capable of altering the position thereof as a result of selected motions of the lead screw, and a lead screw positioner is provided for selectively moving, or preventing the moving of, the movable lead screw by extending and retracting the lead screw through a threaded opening.

DETAILED DESCRIPTION

The expense, weight and contamination risk, servo hydraulic losses due to quiescent operational flows, transient fuel sizing requirements, dynamic impacts of fuel transients, limited ability to fail so as to provide fuel at a fixed fuel flow rate, etc., of electrohydraulic control systems for fuel pumps can be avoided in substantial degree by using a displacement adjustment motor of a suitable kind but instead under electromechanical system control. Such an electromechanical controller selectively rotates a lead screw in one direction or the other to thereby move the changeable position displacement control element of the fluid, or fuel, pump being controlled. In addition, such an arrangement allows for determining if much of the system is in satisfactory operating condition without the need to pressurize the fuel. Further, in the event of a failure in the displacement adjustment motor such because of an electric power outage, the displacement control element for the pump can be left in just the position it was in immediately before the failure to thereby maintain the same fuel flow assuming the pump rotor is being rotated from some other power source such as the engine being fueled by the pump.

Figure 1:
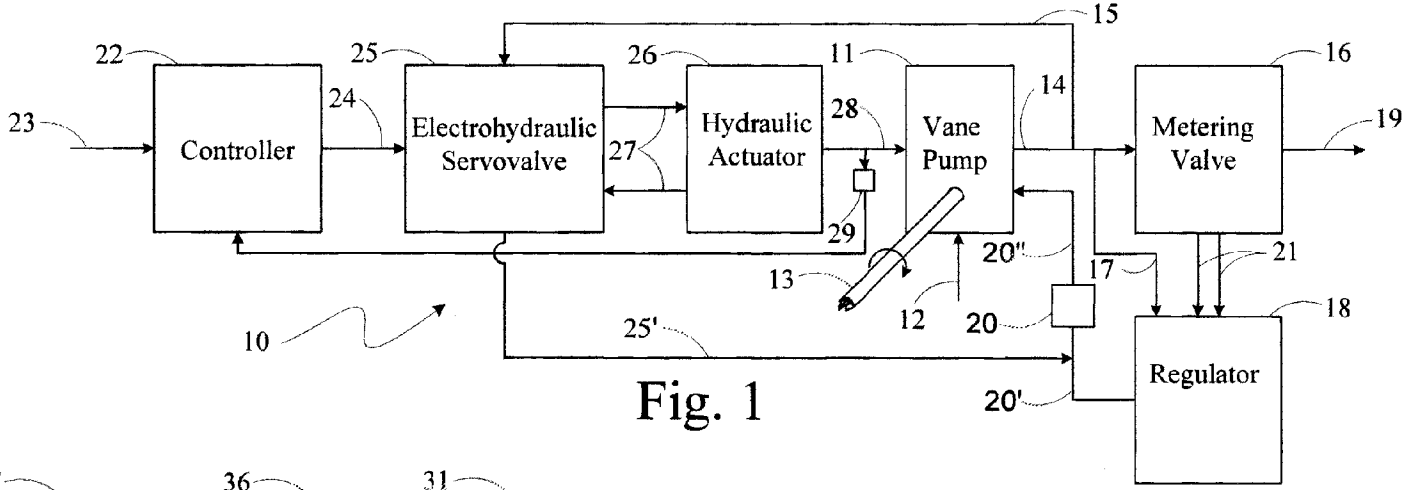
FIG. 1 shows a schematic block diagram of a conventional pump control system and pump.
Figure 2:
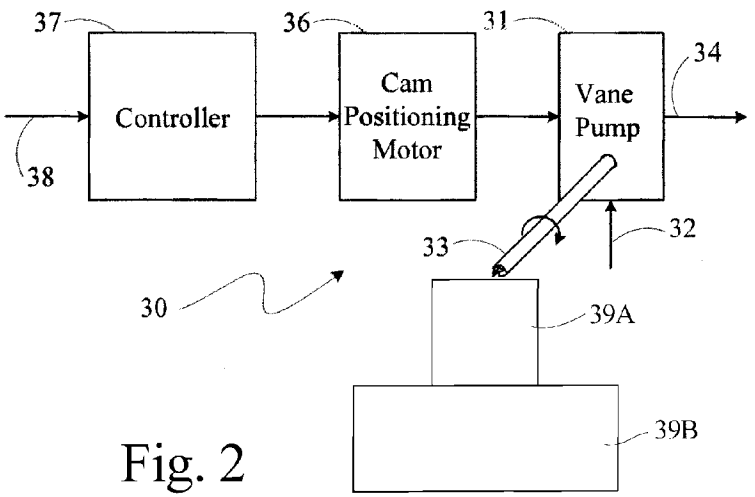
FIG. 2 shows a schematic block diagram of a pump control system and pump system embodying the present invention.
Figure 3:
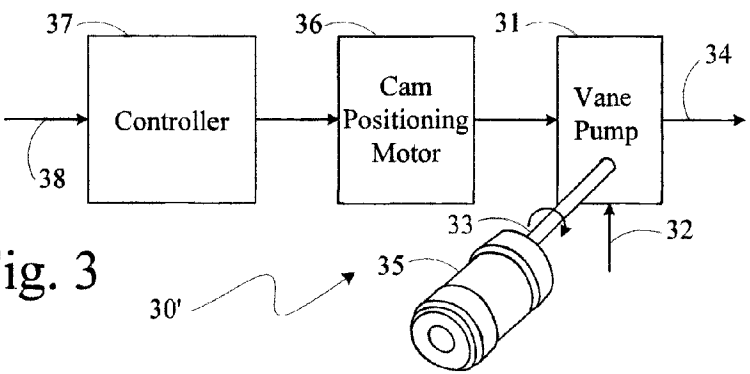
FIG. 3 shows a schematic block diagram of an alternative conventional pump control system and pump system embodying the present invention.
Figure 4:
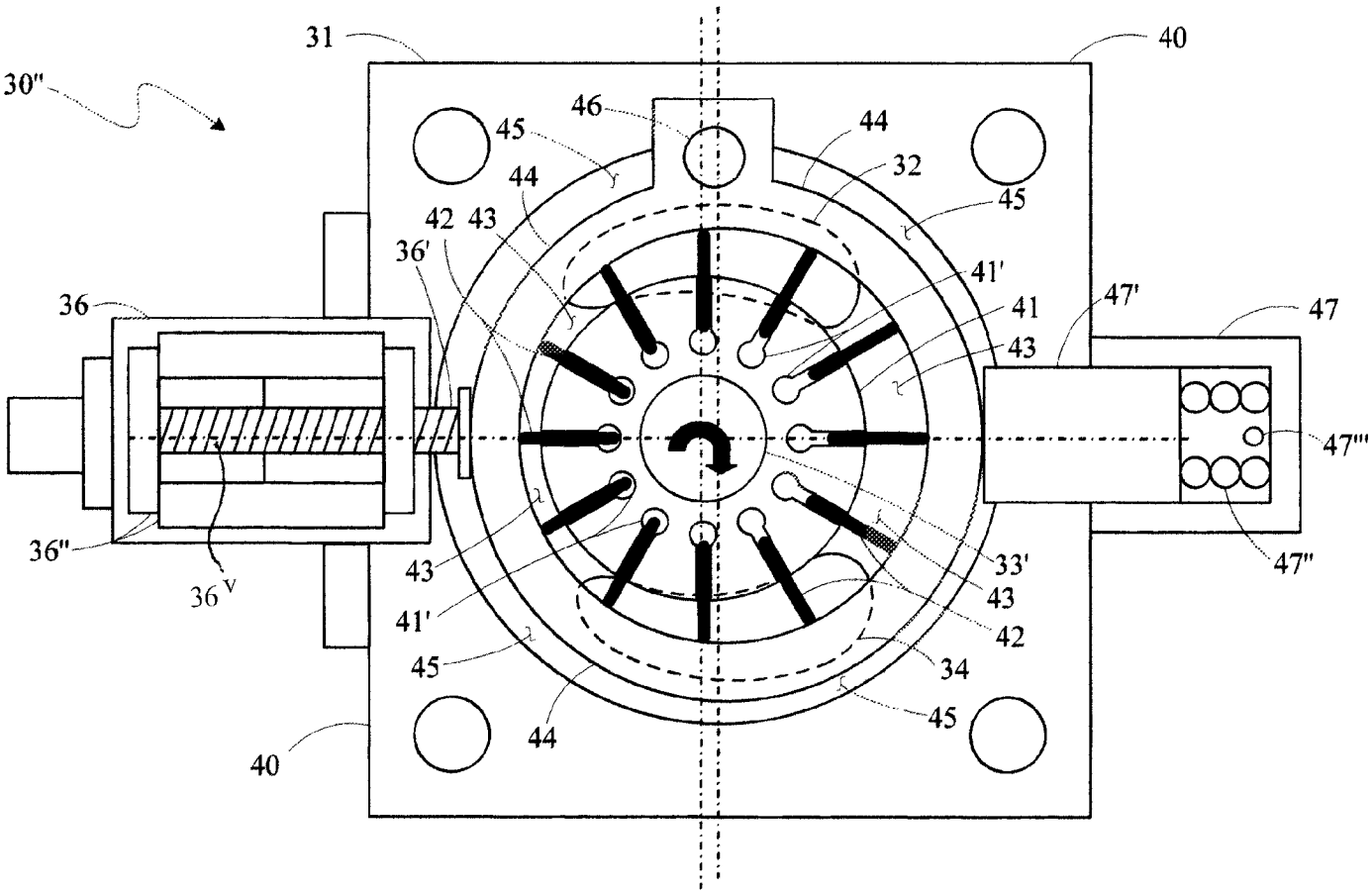
FIG. 4 shows a schematic representation in a cross section view of system components for use in the systems of FIGS. 2 and 3.

FIG. 2 shows a schematic block diagram of an arrangement for such a pump control system, 30, and a variable displacement vane pump, 31, controlled. thereby with this pump appearing in more detail in the schematic representation of FIG. 4. Vane pump 31 has an inlet, 32, to which fuel is supplied, and has its rotor connected to a drive shaft, 33, to which torque for rotating that pump rotor is supplied by an external power source (not shown). In an aircraft, shaft 33 can extend from a gearbox 39A associated with a turbofan gas turbine engine 39B. Vane pump 31 also has an outlet, 34, from which fuel pressurized by this pump is provided. An alternative torque supply means for vane pump 31 is shown in the alternative arrangement, 30', in the schematic block diagram of FIG. 3 in which shaft 33 is rotated by a locally provided electric motor, 35. This alternative arrangement thereby allows independent control of the pump rotor rotation rate rather than having it, if an aircraft, as an example, merely follow the rotation rate established by the aircraft propulsion turbofan gas turbine engine 39B during aircraft operations.

The displacement adjustment motor for vane pump 31 in each of FIGS. 2 and 3 is a cam positioning motor arrangement, 36, to be used for changing the fluid volume displacement provided by that pump. Cam positioning motor arrangement 36 is shown in those figures to be under the control of an electronic controller, 37, which receives both commands to change thrust and various sensor inputs at its input, 38. Controller 37 may again be provided as part of the electronic engine controller (not shown), as is typical in an aircraft, or as an independent controller as shown, and may then be provided on or in the body of pump 31. Such an independent controller is typically provided as being capable of interacting with the electronic engine controller for the aircraft propulsion turbofan gas turbine engine 39B if arrangement 30' is provided in an aircraft. Similarly, in FIG. 3, torque supply electric motor 35 may be controlled by the electronic engine controller in this circumstance, or it may be controlled by independent controller 37, typically interacting with the electronic engine controller, or, possibly, by a further independent controller.

There is shown in the cross section view of FIG. 4 a schematic representation of a pump control system, 30", (omitting controller 37) with vane pump 31 and cam positioning motor arrangement 36 of FIGS. 2 and 3. Vane pump 31 has a pump body, 40, through which inlet 32 is provided to admit the working fluid to be pumped, and through which outlet 34 is provided for the pumped fluid to exit this pump. A rotor shaft, 33', extends through a bushing or a bearing in a rotation opening in pump body 40 to externally connect to drive shaft 33 of either of FIGS. 2 or 3, is also affixed in a circular pump rotor, 41, to thereby be rotatable together about the axis of symmetry of rotor shaft 33' in the direction of the broad arrow shown within the rotor shaft outline.

Rotor 41 has slot openings, 41', each provided therein extending parallel to a * corresponding rotor radius and each is symmetrically positioned at every thirty degrees about the rotor center to thereby provide twelve of them in this example. Each of these slot openings opens at an outer end thereof to the outside of rotor 41 at the outer periphery thereof, and each opens into a spherical void at its interior end inside rotor 41.

Positioned in each of slot openings 41' is a corresponding vane, 42, which can move radially inward and outward in its slot opening along the radial axis therethrough. During rotations of rotor 41, vanes 42 are forced outwardly against the interior surface of a circular opening, 43, in a circular cam ring, 44, to each significantly seal against that surface. Vanes 42 are so forced through use of fluid under pressure entering the spherical void of each slot opening to push the vane outward, or possibly just by use of the resulting centrifugal force on the vane due to the rotation thereof, or both. Rotor 41 within interior opening 43 of cam ring 44, and cam ring 44, are together positioned in an interior, circular cross section, accommodating space, or interior cavity, 45, in pump body 40. Cam ring 44 is pivotable about a pivot pin, 46, affixed through a pivot outward protuberance from the ring part thereof in the plane of that ring, and into pump body 40 which is shown offset horizontally in the figure from the axis of symmetry of rotor shaft 33'. This offset thereby leaves rotor 41 eccentrically mounted within interior opening 43 of cam ring 44. Such a mounting eccentricity leaves rotor 41 closer to the left side of the interior surface of circular opening 43 in cam ring 44 than it is to the right side of that interior surface. However, this relative closeness to, and remoteness from, the left and right sides of the interior surface of interior opening 43 of cam ring 44 can be altered by the pivoting of cam ring 44 about pivot pin 46 (and so an initial offset need not be provided as it can be supplied through this altering of closeness provided by pivoting of cam ring 44).

Such pivoting of cam ring 44 about pivot pin 46 is forced by cam positioning motor arrangement 36 (mounted on the exterior of pump body 40 using a flange) through selective positioning of a lead screw, 36', that is in contact with cam ring 44 through an opening in pump body 40. Lead screw 36' of cam positioning motor arrangement 36, in being activated so as to force cam ring 44 maximally to the right in FIG. 4, provides the greatest offset between the center of cam ring 44 and the center of rotation of rotor 41 about the axis of symmetry of rotor shaft 33' to thereby yield the greatest pump volume displacement. A horizontal axis through lead screw 36' and the center of rotation of rotor 41 about the axis of symmetry of rotor shaft 33' is shown in dashed line form in FIG. 4. Two vertical axes, each perpendicular to this horizontal axis, are also shown in dashed line form in FIG. 4, one through the center of rotation of rotor 41 about the axis of symmetry of rotor shaft 33' and one through pivot pin 46 thereby showing the horizontal offset of these two locations.

The horizontal axis through the center of rotation of rotor 41 intersecting lead screw 36' also extends from lead screw 36' through rotor 41 to a return force arrangement, 47, positioned about that axis on the opposite side of cam ring 44 from lead screw 36'. Lead screw 36' of cam positioning motor arrangement 36, in being activated to withdraw maximally to the left in FIG. 4, allows return force arrangement 47 to force cam ring 44 also to the left to provide the smallest offset (if an initial offset is provided as, otherwise, a zero offset could be reached) between the center of cam ring 44 and the center of rotation of rotor 41 about the axis of symmetry of rotor shaft 33' to thereby yield the smallest pump volume displacement.

Cam positioning motor arrangement 36 is usually a suitable kind of linear actuator typically having a lead screw, such as lead screw 36', selectively forced to rotate in one direction or the other by an electric motor, 36", such as switched reluctance motor, a stepper motor or a permanent magnet motor as examples. Rotation of lead screw 36' causes it to move right or left in FIG. 4, depending on the direction of its rotation, through a threaded opening in the outer structure of motor 36" (serving as the "nut" within which the lead screw is turned).

Control of the position of lead screw 36' can be implemented using a position measuring feedback sensor to provide a screw position signal to controller 37 rather than this controller just positioning the screw on an open loop basis. Alternatively, such a feedback signal can be provided by using an arrangement to measure and transmit to controller 37 the occurrences of motor coil energizations and so the number of rotations of a motor output shaft **36*v*, or some other manner of counting shaft rotations of the motor output shaft 36*v* or the screw can be used. In another manner, a flow sensor can be placed in the fuel line following pump 31 to provide a feedback signal to controller 37** for control purposes.

Of course, motor 36" must be chosen to be capable of generating enough torque to rotate lead screw 36' so as to have that screw provide a linear force along its axis of longitudinal symmetry sufficient to overcome the return force provided by a return force arrangement, 47, mounted on the exterior of pump body 40. Return force arrangement 47 has a slidingly movable interface plug, 47', or piston, in contact with cam ring 44 through an opening in pump body 40, that is pushed by a spring, 47", which is initially partially compressed. This plug 47' and spring 47" together are provided in an open interior truncated cylindrical shell, or hollow cylinder, that is attached to the exterior of pump body 40 so as to be positioned about the corresponding opening therein used for admitting plug 47'. The spring constant of spring 47" essentially determines the amount of force provided by that spring at different spring length compressions, and so the return force applied by arrangement 47 to cam ring 44 at various positions thereof. In addition to, or instead of, use of spring 47", fuel under pressure can be admitted the cylinder through an opening, 47'", behind plug 47' to push it against cam ring 44. The pressure of this fuel can be selected to an extent by connecting opening 47'" to a location ahead of pump inlet 32 or a location following pump outlet 34, or fuel under a pressure intermediate to these two pressures can be provided by mixing fuel quantities at these different pressures through an orifice system.

The geometry of the threads of lead screw 36', and the threads in the cam positioning motor arrangement 36 that engage therewith serving as the nut about this screw, along with the effective friction coefficient between them, (and, or just, the fuel pressure in the cylinder) determine the amount of linear force that must be provided by return force arrangement 47 to force lead screw 36' through cam ring 44 to the left in FIG. 4 in the absence of torque being supplied by motor 36". The choice of this thread geometry and the choice of the spring constant for spring 47" (and, or just, the fuel pressure in the cylinder) thus determines whether lead screw 36' will be moved to the left in the figure in the absence of torque being supplied by motor 36" such as following termination of operation of pump control system 30 and a variable displacement vane pump 31 by command or by some system failure.

That is, if return force arrangement 47 cannot force lead screw 36' through cam ring 44 to the left in a system failure that leaves drive shaft 33 continuing to rotate pump rotor 41 at the same angular rate, such a failure will result in no change in the flow rate of fuel pumped by pump 31 to outlet 34 thereof. If, alternatively, return force arrangement 47 can force lead screw 36' to the left in a system failure that leaves drive shaft 33 continuing to rotate pump rotor 41 at the same angular rate, such a failure will nevertheless result in a significantly reduced rate of flow of fuel pumped by pump 31 to outlet 34 thereof as a result of the reduced pump displacement due to the forcing of lead screw 36' to the left.

The opposite result can be achieved by interchanging the positions shown in FIG. 4 of cam positioning motor arrangement 36 and return force arrangement 47 of FIGS. 2 and 3 with respect to cam ring 44. This arrangement is shown in a schematic representation of a pump control system, 30'", in the cross section view of FIG. 5 with vane pump 31 and the positionally interchanged cam positioning motor 36 and return force arrangement 47. Here, if return force arrangement 47 cannot force lead screw 36' through cam ring 44 to the right in a system failure that leaves drive shaft 33 continuing to rotate pump rotor 41 at the same angular rate, such a failure again will result in no change in the flow rate of fuel pumped by pump 31 to outlet 34 thereof. If, alternatively, return force arrangement 47 can force lead screw 36' to the right in a system failure that leaves drive shaft 33 continuing to rotate pump rotor 41 at the same angular rate, such a failure will nevertheless result in a significantly increased rate of flow of fuel pumped by pump 31 to outlet 34 thereof as a result of the increased pump displacement due to the forcing of lead screw 36' to the right.

The preciseness with which the flow rate of the fluid pumped by vane pump 31 can be set by cam positioning motor arrangement 36 in having lead screw 36' rotated by motor 36" therein is determined in FIG. 4 by the minimum movement to the right or left of that lead screw through a threaded opening in the motor frame serving as the "nut"

through which the lead screw turns. This linear motion in one of two opposite directions occurs in response to that motor being directed to provide its smallest angular position increment of its output shaft 36v in a corresponding rotation direction which, of course, is then also the smallest angular increment available to the lead screw 39' forming that shaft 36v. This smallest angular increment possible to be provided to its output shaft 36v by motor 36" can be converted to a significantly smaller angular increment for lead screw 36' by interposing a set of angular motion reducing gears between the motor output shaft and the lead screw 36'.

Figure 6:
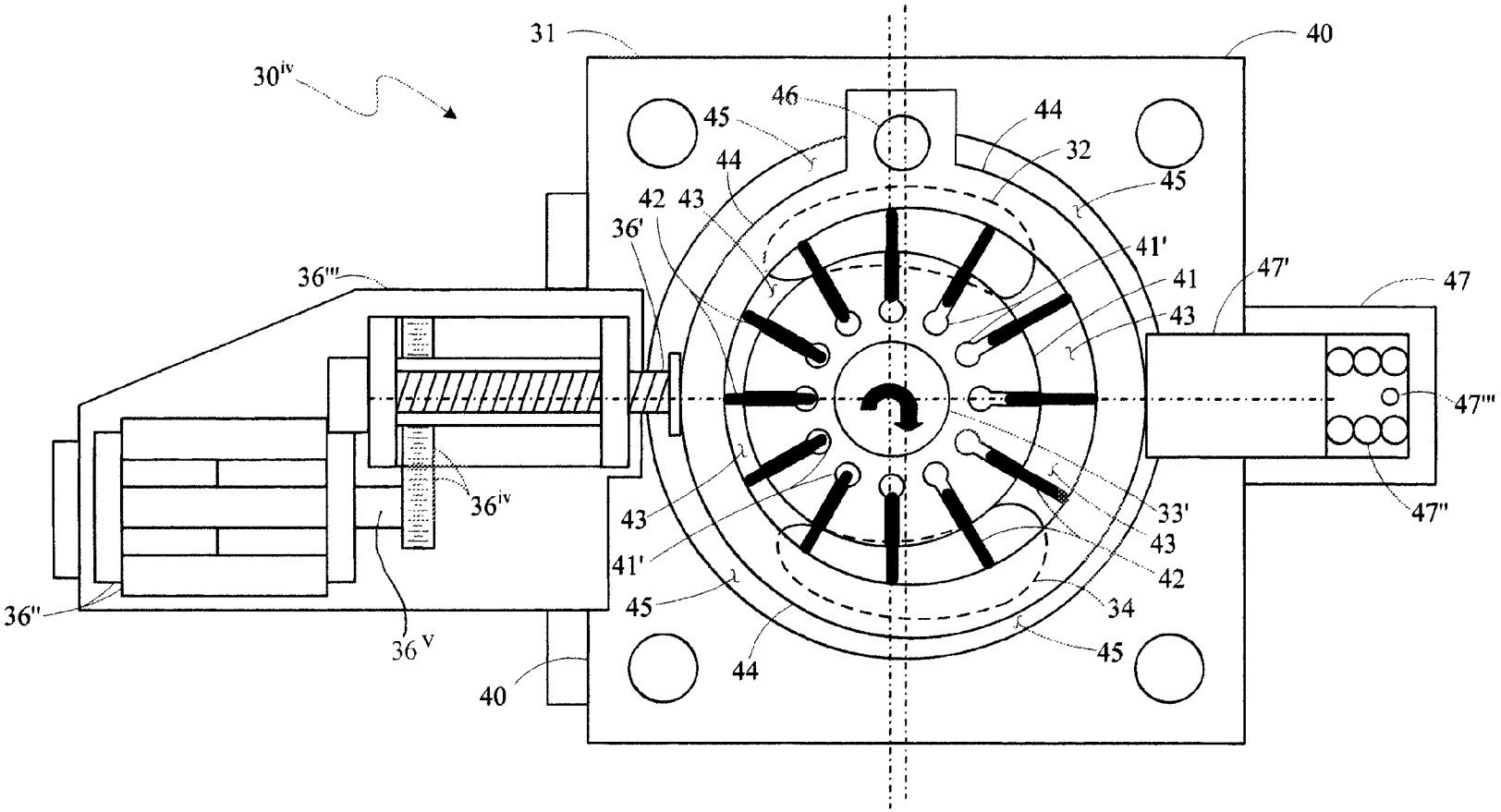
FIG. 6 shows a schematic representation in a cross section view of alternative system components for use in the systems of FIGS. 2 and 3.

FIG. 6 shows, in a cross section view a schematic representation of a pump control system, $30^{iv}$, a combined cam positioning motor and gearbox arrangement, 36'", having therein such a set of angular motion reducing gears, $36^{iv}$. The teeth of the gear shown on the end of motor output shaft 36v drives a gear with more teeth formed on a rotatable gearbox "nut" structure rotatably supported on the motor and gearbox frames. Rotation of the gearbox "nut" structure motor 36" in one direction or the other again forces lead screw 36' to a corresponding right or left motion but at a smaller angular rate than that of the motor. Of course, the opposite result can be provided to give lead screw 36' a greater angular rate by reversing the gear teeth ratio of reducing gears $36^{iv}$ if instead desired.

The preciseness with which the flow rate of the fluid pumped by vane pump 31 is controlled can alternatively, or in addition, be provided by use of a fuel metering system of the kinds used previously with "fueldraulic" control systems described generally above. That is, a metering system following vane pump 31, having a metering valve under control: of a regulator, can be operated to provide the desired rate of fuel flow at its outlet with the overflow fuel from the metering valve recirculated to pump 31 by the regulator after being received from the valve. Such a metering system could be provided following vane pump 31 in pump control system 30" of FIG. 4, thereby providing flow rate precision control in substituting in place of gears $36^{iv}$ and combined cam positioning motor and gearbox arrangement 36'" in pump control system $30^{iv}$ in FIG. 6. Alternatively, such a metering system could be provided following vane pump 31 in pump control system $30^{iv}$ in FIG. 6 to provide a finer resolution the control of the flow rate.

Figure 5:
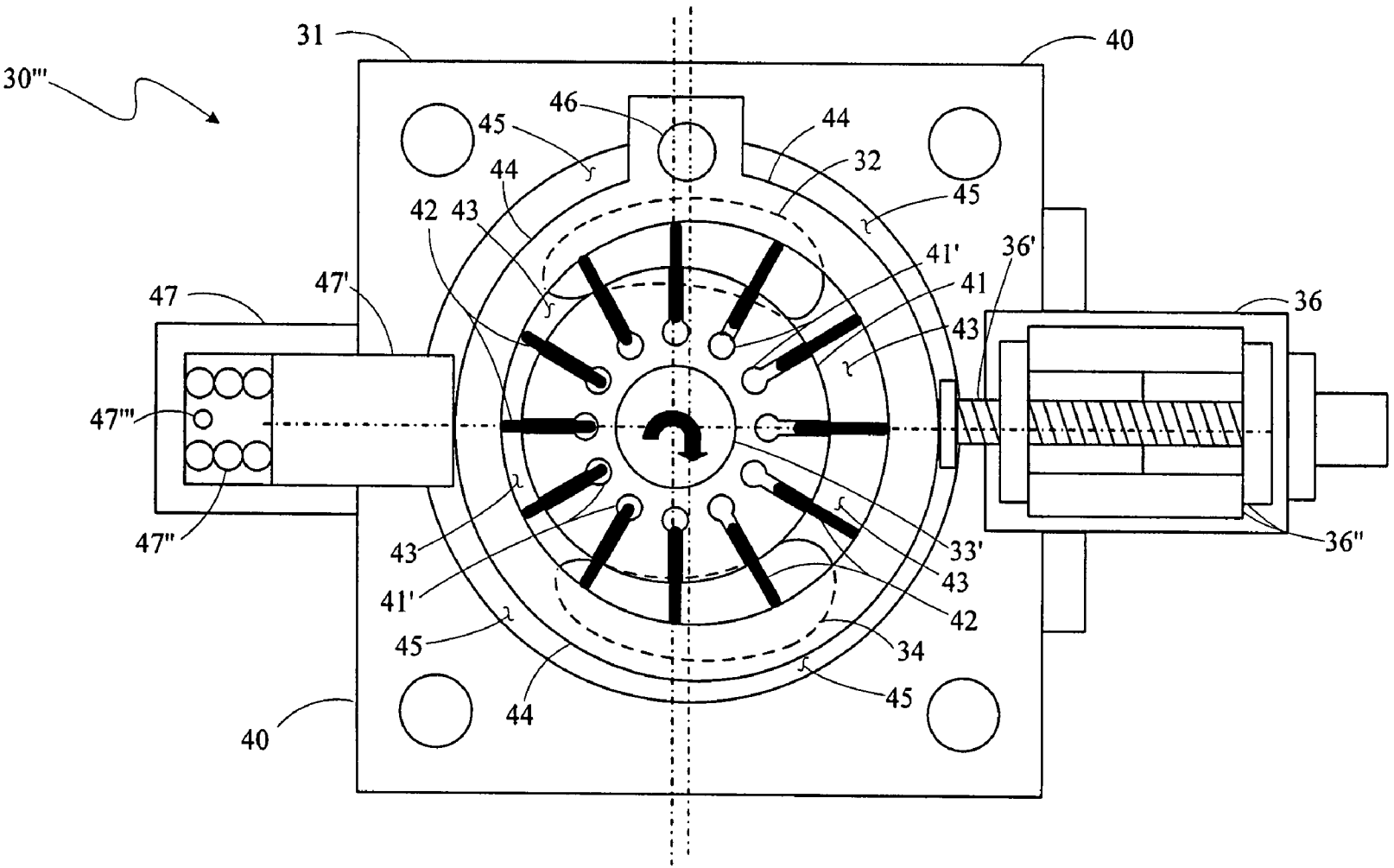
FIG. 5 shows a schematic representation in a cross section view of alternative system components for use in the systems of FIGS. 2 and 3.
Figure 7:
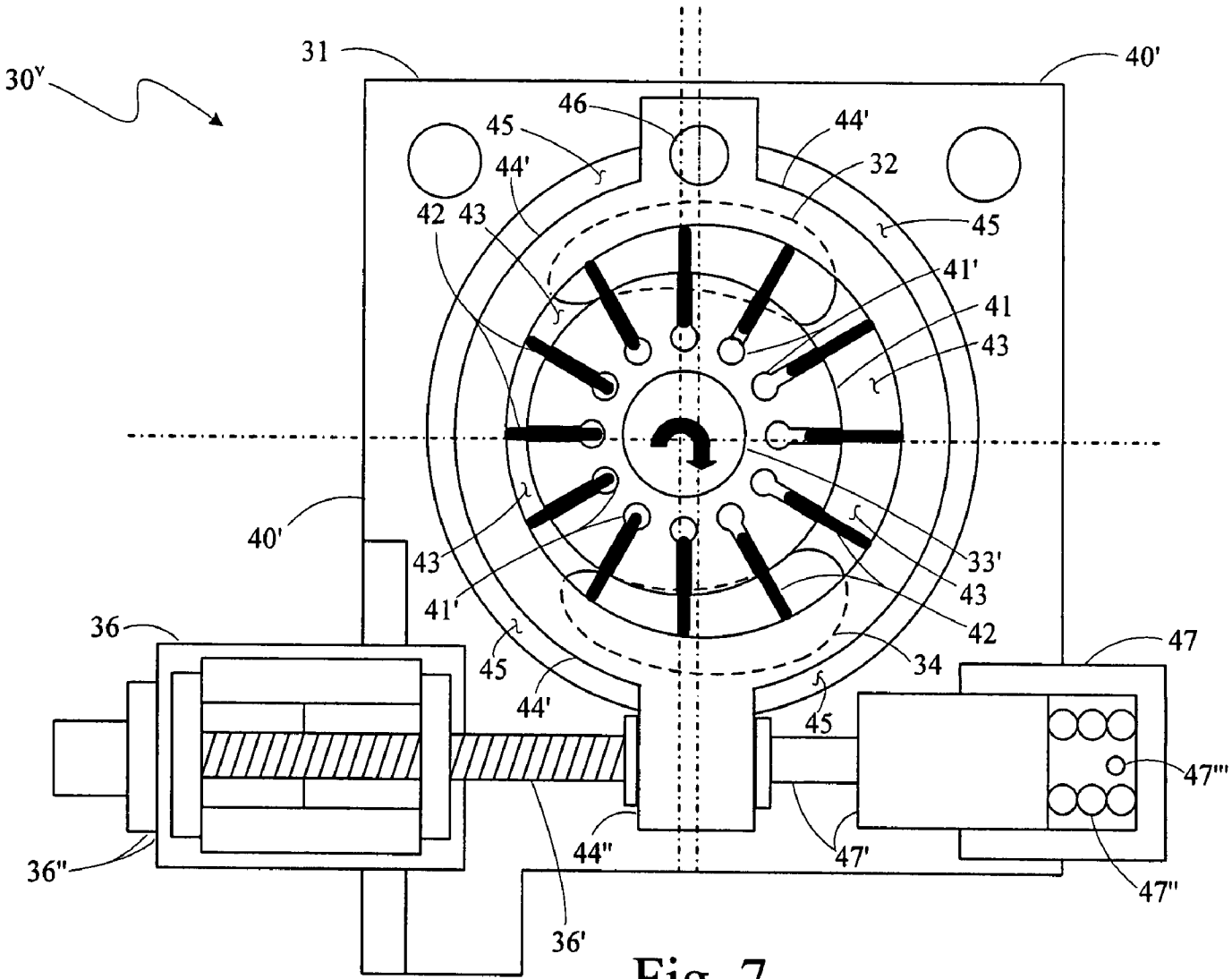
FIG. 7 shows a schematic representation in a cross section view of alternative system components for use in the systems of FIGS. 2 and 3.
Figure 8:
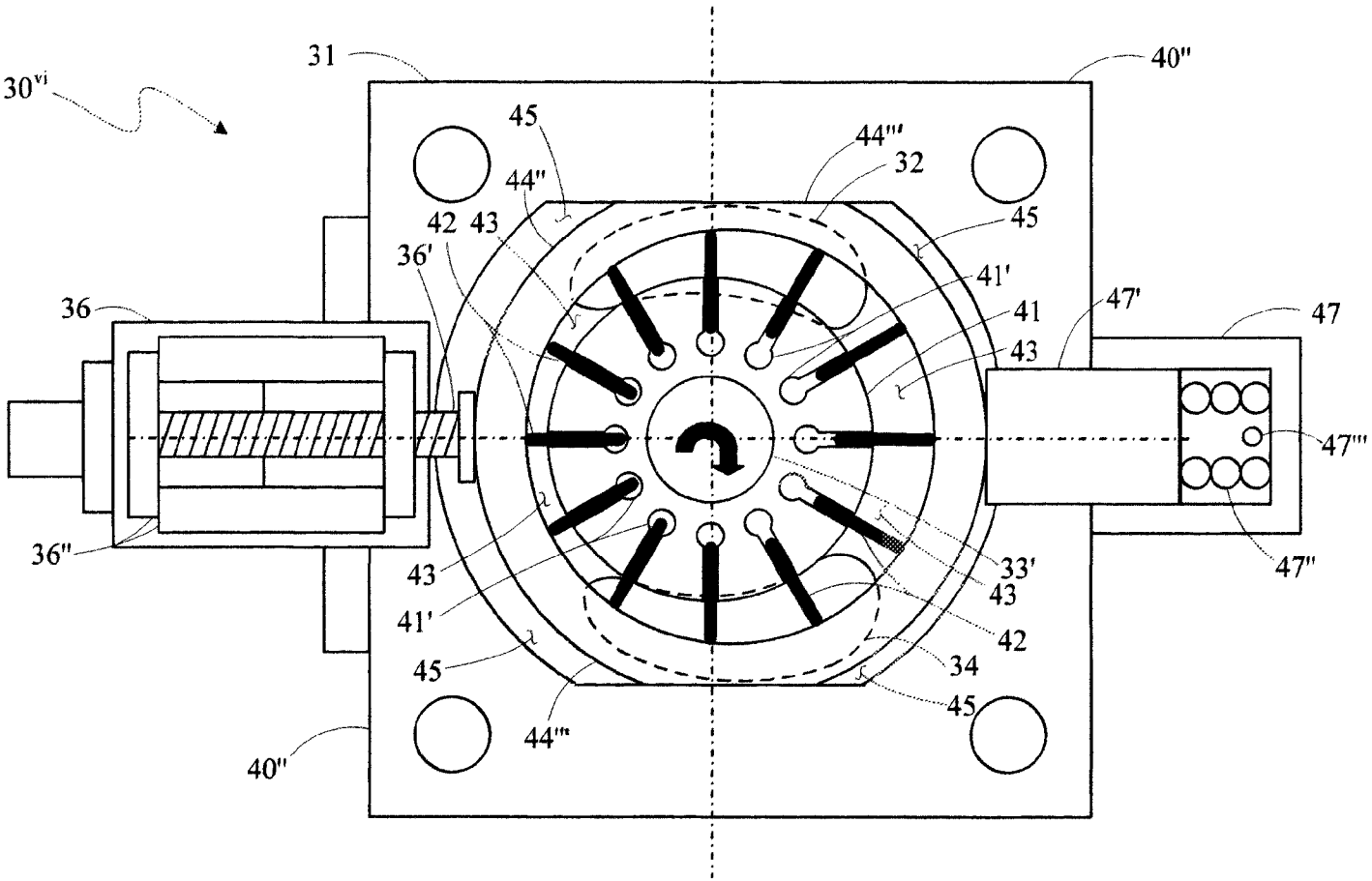
FIG. 8 shows a schematic representation in a cross section view of alternative system components for use in the systems of FIGS. 2 and 3.

Alternatives for cam ring 44 of FIGS. 4, 5 and 6 are shown in cross section views of schematic representations of pump control systems in FIGS. 7 and 8. Rather than lead screw 36' being forced directly against the ring part of cam ring 44 as in FIGS. 4, 5 and 6, a pump control system, $30^{v}$, is shown in FIG. 7 with a modified cam ring, 44'. Modified cam ring 44' has a protuberance in the plane of the ring, or boss, 44", outward from the ring part thereof directly across from the pivot outward protuberance through which pivot pin 46 is affixed into pump body 40. Cam positioning motor arrangement 36 and return force arrangement 47 are repositioned in a modified pump body, 40', to be on opposite sides of boss 44" to each thereby be capable of rotating modified cam ring 44' as in pump control system 30" of FIG. 4. Of course, interchanging the positions of cam positioning motor arrangement 36 and return force arrangement 47 allows them to be capable of rotating modified cam ring 44' as in pump control system 30'" of FIG. 5.

A cross section view of a schematic representation of a pump control system, $30^{vi}$, in FIG. 8 shows that pivotable cam ring 44 of FIGS. 4, 5 and 6, and modified cam ring 44' of FIG. 7, can have substituted therefor a slidable cam ring, 44'", provided in a suitably modified pump body, 40". Cam positioning motor arrangement 36 and return force arrangement 47 are again positioned in modified pump body 40" to be on opposite sides of slidable cam ring 44'" to each thereby be capable of pushing to the right or the left, respectively, that ring to thereby alter the flow displacement in vane pump 31 as for cam rings 44 and modified cam ring 44" as in the previously described pump control systems of FIGS. 4, 6 and 7. Again, interchanging the positions of cam positioning motor arrangement 36 and return force arrangement 47 allows them to be capable of pushing to the left or the right, respectively, slidable cam ring 44'" to thereby alter the flow displacement in vane pump 31 as provided for cam ring 44 in the previously described pump control system of FIG. 5.

Although the present invention has been described with reference to preferred embodiments, workers skilled in the art will recognize that changes may be made in form and detail without departing from the spirit and scope of the invention.

The invention claimed is:

1. A variable displacement pump and pump control system therefor to pump a fluid at selected pump output flow rates in a range of pump output flow rates, the system comprising:

a variable displacement pump having a rotor shaft with which to rotate a pump rotating member about an axis of rotation to force fluid that has entered a pump inlet to a pump outlet, and a fluid volume displacement selection controller to select a volume of fluid to be forced from the pump inlet to the pump outlet by the rotating member during a rotation thereof, a movable lead screw coupled to directly transmit force to the displacement selection controller so as to alter the position thereof as a result of selected motion of the movable lead screw, and a lead screw positioner for selectively moving, or preventing the moving of, the movable lead screw by extending and retracting the movable lead screw through a threaded opening, wherein the lead screw positioner comprises an electrically powered motor, and wherein the lead screw positioner extends and retracts the movable lead screw by rotating the movable lead screw.

2. The system of claim 1 further comprising a position return force arrangement coupled to the displacement selection controller so as to tend to return the displacement selection controller to at least one position from which it was altered by motion of the movable lead screw.

3. The system of claim 2 wherein the position return force arrangement returns the displacement selection controller to at least one position from which it was altered by motion of the movable lead screw if the lead screw positioner is neither moving nor preventing the moving of the movable lead screw.

4. The system of claim 3 wherein the returning by the position return force arrangement of the displacement selection controller to at least one position from which it was altered by motion of the movable lead screw increases the volume of fluid to be forced to the pump outlet by the rotating member during a rotation thereof.

5. The system of claim 3 wherein the returning by the position return force arrangement of the displacement selection controller to at least one position from which it was altered by motion of the movable lead screw decreases the volume of fluid to be forced to the pump outlet by the rotating member during a rotation thereof.

6. The system of claim 2 wherein the position return force arrangement does not return the displacement selection controller to at least one position from which it was altered by motion of the movable lead screw if the lead screw positioner is neither moving nor preventing the moving of the movable lead screw.

7. The system of claim 1 wherein the electrically powered motor has an output shaft and drives the output shaft to rotate at a selected rotation rate.

8. The system of claim 7 wherein the motor output shaft also comprises the movable lead screw.

9. The system of claim 7 wherein the motor output shaft is coupled to the movable lead screw.

10. The system of claim 9 wherein the motor output shaft is coupled to the movable lead screw through a gear set.

11. The system of claim 1 wherein the displacement selection controller is a movable structure in the variable displacement pump with movements thereof changing the volume of fluid forced to the pump outlet by the rotating member during a rotation thereof.

12. The system of claim 11 wherein the variable displacement pump is a vane pump.

13. The system of claim 12 wherein the displacement selection controller in the vane pump comprises a movable cam ring surrounding the pump rotating member with a ring portion axis of symmetry substantially parallel to the axis of rotation but offset therefrom.

14. The system of claim 13 wherein the cam ring is pivotable about a pivot axis substantially parallel to the ring portion axis of symmetry but located adjacent to a part of the ring portion.

15. The system of claim 12 wherein the displacement selection controller comprises a cam ring which is slidable in a direction substantially perpendicular to the ring portion axis of symmetry.

16. The system of claim 1 further comprising an electric motor coupled to the rotor shaft.

17. A variable displacement pump and pump control system therefor provided in an aircraft to pump a fuel to a gas turbine engine at selected pump output fuel flow rates in a range of pump output fuel flow rates, the system comprising:

a variable displacement pump having a rotor shaft coupled to a gearbox coupled in turn to the gas turbine engine with which to rotate a pump rotating member about an axis of rotation to force fluid that has entered a pump inlet to a pump outlet, and a fluid volume displacement selection controller to select a volume of fluid to be forced from the pump inlet to the pump outlet by the rotating member during a rotation thereof, a movable lead screw coupled to directly transmit force to the displacement selection controller so as to alter the position thereof as a result of selected motion of the movable lead screw, and a lead screw positioner for selectively moving, or preventing the moving of, the movable lead screw by extending and retracting the movable lead screw through a threaded opening, wherein the lead screw positioner comprises an electrically powered motor, and wherein the lead screw positioner extends and retracts the movable lead screw by rotating the movable lead screw.

18. The system of claim 17 further comprising a position return force arrangement coupled to the displacement selection controller so as to tend to return the displacement selection controller to at least one position from which from which it was altered by motion of the movable lead screw.

19. The system of claim 18 wherein the position return force arrangement returns the displacement selection controller to at least one position from which it was altered by motion of the movable lead screw if the lead screw positioner is neither moving nor preventing the moving of the movable lead screw, thus decreasing the volume of fluid to be forced to the pump outlet by the rotating member during a rotation thereof.

20. The system of claim 18 wherein the electrically powered motor has an output shaft and drives the output shaft to rotate at a selected rotation rate.

* * * * *